United States Patent [19]

Kaufman et al.

[11] 4,252,092

[45] Feb. 24, 1981

[54] COMPRESSION RELEASE MECHANISM

[75] Inventors: Vernon R. Kaufman, Cedarburg; Thomas G. Guntly, Hartford; William C. Kelly, West Bend, all of Wis.

[73] Assignee: Tecumseh Products Company, Tecumseh, Mich.

[21] Appl. No.: 71,852

[22] Filed: Sep. 4, 1979

[51] Int. Cl.[3] ..... F01L 13/08

[52] U.S. Cl. ..... 123/182; 137/512.4

[58] Field of Search ..... 123/182, 150, 105, 47 AB, 123/73 AA; 137/512.4

[56] References Cited

U.S. PATENT DOCUMENTS

| | | | |
|---|---|---|---|
| 1,115,481 | 11/1914 | Bachle et al. | 123/105 |
| 1,174,765 | 3/1916 | Roessle et al. | 123/73 AA |
| 1,416,771 | 5/1922 | Baleson et al. | 137/512.4 |
| 1,633,772 | 6/1927 | Clapp | 137/512.4 |
| 1,787,856 | 1/1931 | Colter | 123/73 AA |
| 2,742,380 | 4/1956 | Peters | 123/182 |
| 3,417,740 | 12/1968 | Pezlewitz | 123/182 |

*Primary Examiner*—P. S. Lall

*Attorney, Agent, or Firm*—Albert L. Jeffers; Roger M. Rickert

[57] ABSTRACT

An automatic compression release mechanism for an internal combustion engine wherein first and second opposed cantilevered ends of a centrally supported flexible plate forms two independently operating valves to respectively control serially connected inlet and outlet ports of a valve chamber forming a part of a compression release passageway connecting the combustion chamber of the engine with a zone of lower pressure such as the cylinder sidewall exhaust port of a two-cycle engine. The valves are each one-way check valves operating oppositely to one another. The valve controlling the outlet port is normally biased to an open position and remains open when the engine is turned over at the relatively slow cranking speeds normally used to start the engine, relieving somewhat engine compression, thereby facilitating the starting of the engine. The outlet valve is flexed to a closed position in response to a rapid pressure build-up in the chamber caused by ignition of the fuel-air mixture in the engine combustion chamber, thereby sealing the compression release passage after the engine starts. A restricted passageway from the compression release chamber to the zone of lower pressure, such as the cylinder sidewall exhaust port, which passageway is independent of the chamber valves, slowly diminishes the chamber pressure to release each valve to return to its respective open position a predetermined time after the engine stops running. The restricted passageway and the outlet port of the compression release chamber may both be connected to the cylinder sidewall exhaust port by a hollow interior portion of the engine piston pin.

16 Claims, 5 Drawing Figures

COMPRESSION RELEASE MECHANISM

BACKGROUND OF THE INVENTION

The present invention relates generally to compression release arrangements and more particularly to an improved compression release mechanism for an internal combustion engine, for example of the two-stroke cycle variety.

In the illustrative environment of a two-stroke cycle internal combustion engine, U.S. Pat. No. 3,417,740 to Perlewitz, illustrates an automatic compression release mechanism. This known compression release mechanism employs a pair of independently operable reed valves at inlet and outlet ports, respectively, of a compression release chamber. The compression release chamber inlet port is coupled to the engine combustion chamber while the compression release chamber outlet port is coupled to the engine exhaust system. An arrangement for slowly releasing the pressure in the compression release chamber to the atmosphere so that the outlet reed valve assumes the open position when the engine is stopped is also included in this known patented device. In this known compression release device, the two reed valves are separate pieces, separately mounted, and the compression release exhaust port is ducted to the engine exhaust system while the arrangement for slowly leaking or bleeding pressure from the compression release mechanism is ducted to the atmosphere.

While this known compression release mechanism has met with considerable commercial success, the compression release function sometimes deteriorates and may cease to function in warm weather applications, such as lawnmowers, because the passage to the zone of lower pressure, such as the exhaust passage of the engine, sometimes plugs with combustion deposits. Further, the cost of this known compression release arrangement, while not prohibitive, is higher than desirable.

SUMMARY OF THE INVENTION

Among the several objects of the present invention may be noted the provision of an automatic compression release mechanism for an internal combustion engine characterized by its ease and economy of manufacture as well as its durable and reliable operation; the provision of a compression release arrangement having independent exhaust and pressure bleed passageways both coupled to the engine exhaust port; the provision of a compression release mechanism with first and second valves comprising opposed cantilevered ends of a centrally supported flexible plate; the provision of a compression release mechanism which exhausts to the engine cylinder sidewall exhaust port; the provision of a compression release mechanism employing as a part of the compression release passageway the hollow interior of the engine piston pin; and the provision of a compression release mechanism employing substantially fewer parts and substantially fewer assembly steps than the known prior art compression release mechanisms. These as well as other objects and advantageous features of the present invention will be in part apparent and in part pointed out hereinafter.

In general, an automatic compression release mechanism in one form of the invention has a passageway communicating at one end thereof with the combustion chamber of an internal combustion engine and at the other end thereof with a zone, such as the engine exhaust system, in which the pressure is lower than the pressure in the combustion chamber during the compression stroke of the piston with the passageway including a valve chamber having an inlet port and an outlet port serially connecting the chamber in the passageway and with a first one-way valve controlling the inlet and closing the same when the valve chamber pressure exceeds combustion chamber pressure while a second one-way valve is operable independently of the first valve to control the outlet port and tending to close the same when the valve chamber pressure exceeds the pressure in the zone. The second valve is resiliently biased to an open position spaced from the outlet port and is movable to a closed position in response to pressure generated in the passageway when a fuel air mixture is ignited in the combustion chamber. The first and second valves comprise opposed cantilevered ends of a centrally supported flexible plate with both ends being urged to their respective closed positions in response to a pressure build-up in the chamber so that both valves tend to be maintained in a closed position when the engine is running. An arrangement for slowly diminishing the pressure in the chamber to release each valve to return to its respective open position a predetermined time after the engine stops running includes a restricted passageway from the chamber to the zone, the passageway being independent of the second valve. The compression release mechanism passageway may include the cylindrical sidewall exhaust port of a two-stroke cycle engine and may also include the hollow interior portion of the engine piston pin.

BRIEF DESCRIPTION OF THE DRAWING

Corresponding reference characters indicate corresponding parts throughout the several views of the drawing.

Figure 1:
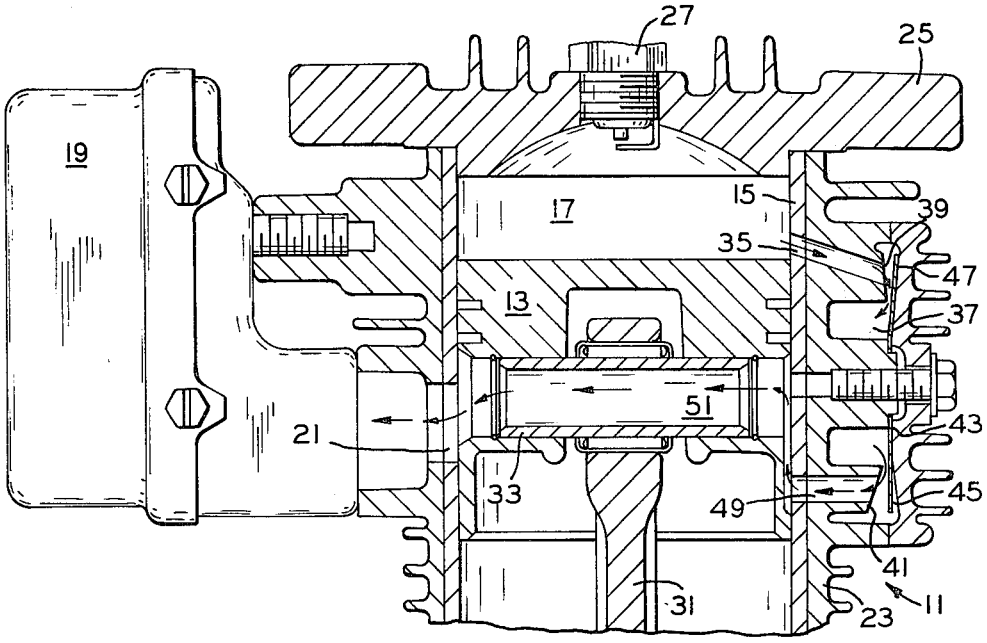
FIG. 1 is a partial cross-sectional view of a two-stroke cycle internal combustion engine illustrating compression of the variable volume combustion chamber with compression release active.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawing generally there is illustrated an internal combustion engine 11 having a piston 13 reciprocable within cylinder liner 15 with the cylinder and piston together defining a variable volume combustion chamber 17.

Internal combustion engine 11 is of generally conventional construction with only portions thereof illustrated for clarity of understanding of the present invention. The internal combustion engine 11 is for illustrative purposes a two-stroke cycle engine having an exhaust muffler 19 connected to cylinder sidewall exhaust port 21 which exhaust port is an opening in the steel liner or sleeve 15 forming the cylinder within an aluminum engine block 23. The cylinder head 25 carries a conventional sparkplug 27. The fuel-air mixture is supplied by way of intake manifold 29 to one or more intake ports in the cylinder wall 15 which ports are positioned somewhat below the exhaust port 21. Piston 13 is coupled to a connecting rod 31 by hollow piston pin 33 with the other end of connecting rod 31 coupled to a crankshaft in conventional manner.

The automatic compression release mechanism includes a passageway which communicates at one end thereof with the combustion chamber as at opening 35 and at the other end thereof with exhaust port 21 or to the atmosphere directly or any other zone in which the pressure is lower than the pressure in the combustion chamber 17 during the compression stroke of piston 13. A valve chamber 37 which may be formed as part of the engine block has an inlet port 39 and an outlet port 41 serially connecting chamber 37 in the passageway. A centrally supported flexible plate 43 has opposed cantilevered ends 45 and 47 forming in conjunction with ports 41 and 39, respectively, independently operable one-way valves each normally biased to its open position. End 47 closes on port 39 to close the first one-way valve when the pressure in the valve chamber 37 exceeds the pressure in combustion chamber 17. The second one-way valve is operable independently of the first valve with end 45 closing on outlet port 41 when the pressure in the valve chamber 37 exceeds the pressure in the valve chamber outlet 49 which pressure is with appropriate piston positioning the same as the pressure at exhaust port 21.

Figure 2:
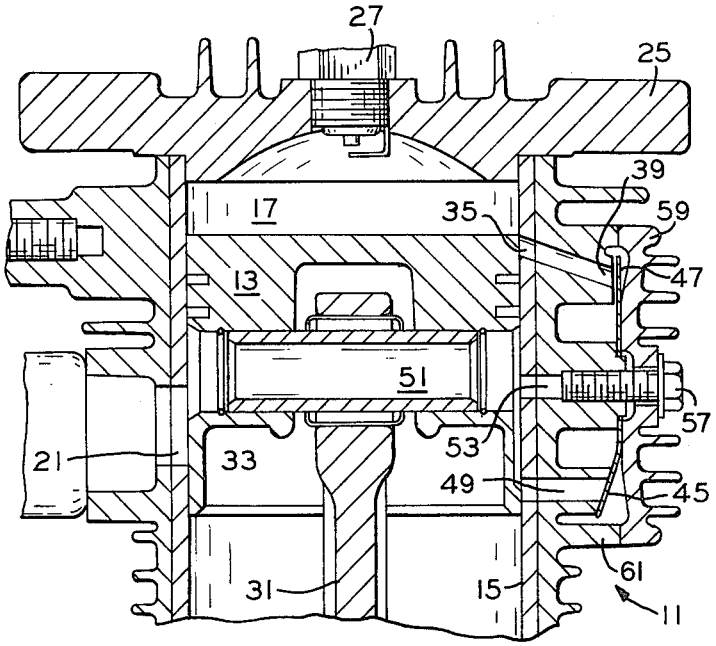
FIG. 2 is a view similar to FIG. 1 but at a later time in the compression stroke of the piston.
Figure 3:
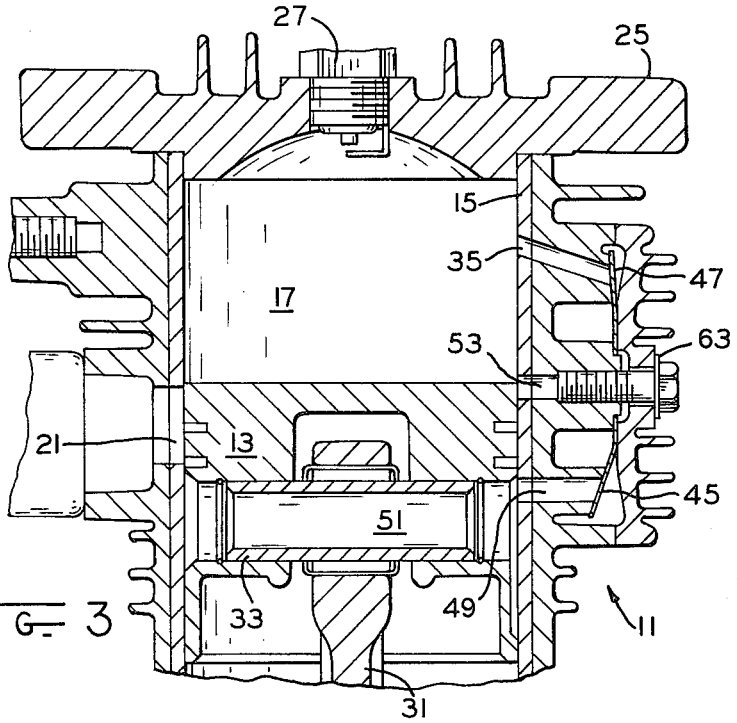
FIG. 3 is a view similar to FIGS. 1 and 2 but illustrating the piston part way through its power stroke and ready to open the exhaust port.

FIG. 1 illustrates piston 13 moving upwardly as during manual cranking of the engine during the compression stroke of the piston. As the volume of the combustion chamber 17 decreases, air and fuel exit by way of opening 35 and open valve 39–47, passing into chamber 37, and by way of the open valve 41–45 and outlet conduit 49 these gases exit through the hollow opening 51 in piston pin 33 and pass through the exhaust port 21 into muffler 19. By the time piston 13 reaches the position illustrated in FIG. 2, opening 35 is closed by the piston 13 and continued upward movement of the piston compresses the air and fuel remaining in the combustion chamber until spark plug 27 ignites that mixture to force the piston downwardly. Upon combustion and the uncovering of opening 35, combustion gases at a relatively high pressure pass through the still open first valve 39–47 into chamber 37, raising substantially the pressure therein and causing the second valve 41–45 to close. Continued downward movement of the piston 13 is accompanied by a diminution of the pressure in combustion chamber 17 and when that pressure becomes less than the pressure in the valve chamber 37, valve 39–47 also closes, creating a captive high pressure within the valve chamber 37. Shortly after this inlet valve closes, the hollow piston pin connection between the exhaust outlet port 21 and outlet 49 from the valve chamber is broken with this interruption occurring just prior to opening of the exhaust port to the combustion chamber as illustrated in FIG. 3. Except for slight controlled leakage from the valve chamber 37, engine operation continues from this point on in a conventional manner. During operation, valve 39–47 occasionally opens somewhat when the combustion chamber is at a nearly maximum pressure to maintain the pressure within valve chamber 37.

Figure 4:
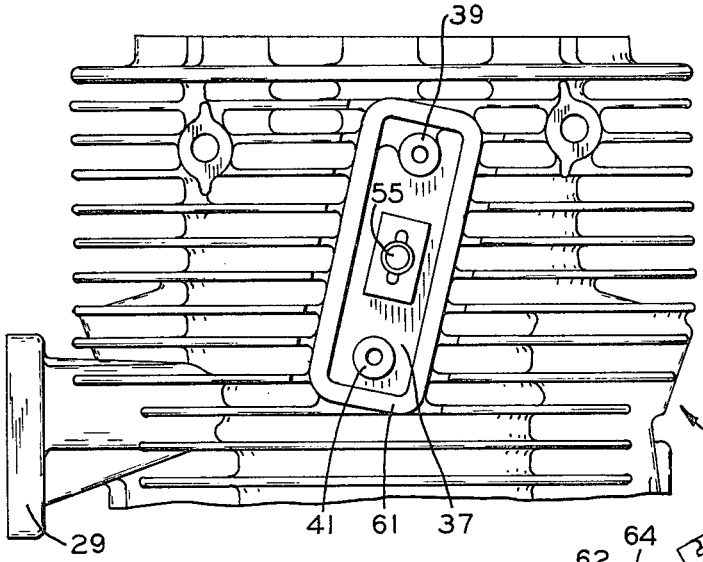
FIG. 4 is a side elevational view of the engine of FIGS. 1 through 3 from the right side thereof with the valve chamber cover removed.
Figure 5:
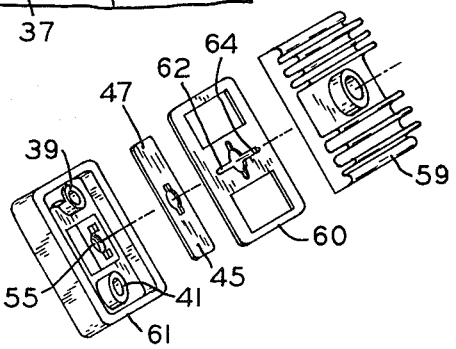
FIG. 5 is an exploded perspective view of the structure forming the compression release valve chamber.

Without some leakage from the valve chamber 37, the pressure therein would be maintained after the engine was stopped and the compression release mechanism would be ineffective on subsequent attempts to start the engine and accordingly controlled leakage or bleeding of the pressure from the valve chamber 37 to slowly diminish that chamber pressure and release each valve to return to its respective open position a predetermined time after the engine stops running is provided by bleed outlet 53. This bleed outlet is connected to the same zone as the outlet 49 from valve chamber 37, namely by way of the hollow opening 51 in the piston pin to the engine exhaust port 21 at those times during which the piston is in proper alignment with the exhaust port 21. Valve chamber 37 is as illustrated in FIGS. 4 and 5 of a somewhat annular configuration with threaded hole 55 centrally located to receive bolt 57 which attaches the cap 59 to the main or body portion 61 of the compression release mechanism. The gasket 60 separating cap 59 and body portion 61 is provided with small openings 62 and 64 so that threaded engagement between bolt 57 and body 61 provides the desired leakage pathway from the chamber 37 to the bleed opening 53.

The opposed cantilevered ends 45 and 47 of the centrally supported flexible plate may upon initial engine combustion as well as at other times be subjected to substantial forces. To prevent these forces from bending the plate sufficiently to exceed its elastic limit distorting or damaging the plate so that it fails to provide its intended valving function, cap 59 is relieved just sufficiently on the sides of the plate ends opposite the inlet and outlet ports to allow movement of the plate ends away from the inlet and outlet ports by only a limited amount.

The cover 59 of course functions to clamp the cantilevered reed in place as well as clamping the gasket 60 between cover 59 and the valve chamber body portion 61. A further gasket 63 may be provided to prevent the controlled leakage from entering the atmosphere and to insure that all such controlled leakage is by way of opening 53 and piston duct 51 to the exhaust port. With the single bolt 57 tying the entire assembly together, there is a substantial saving in assembly time and the number of parts required as compared to the afore-mentioned prior patented device. One reed, rather than two, is required and the previously used two reed hold-down screws are eliminated. No additional parts are required from limiting reed movement and all necessary ducting and porting occurs in the body portion 61.

The current design also allows the compression release arrangement to be located in a cool part of the cylinder directly in the path of cooling air being forced over the cylinder by the engine cooling fan. This location permits more uniform heat dissipation fins on the outer portions of the cylinder where heat dissipation is critical and the function of the compression release mechanism is not adversely affected by hot weather use because the passageway 49 to the zone of lower pressure is very short and in an area of lower temperatures which eliminates the passageway carboning problem mentioned earlier in conjunction with the prior patented arrangement. This small passageway 49 communicates with a large relief area in the side of the piston and through the piston pin duct to the engine exhaust passage. While this passageway, as well as the leakage passageway 53, could communicate directly to the atmosphere or with the crankcase, venting through the exhaust system is preferred since it eliminates the problems of oil dripping or spray and avoids the possibility of partial combustion within the crankcase as might occur in the event of failure of the compression release mechanism.

While the present invention has been described in the environment of a two-stroke cycle engine, the applicability of the invention is not limited to such an exemplary environment. For example, if the compression release arrangement of the present invention were employed in a four-stroke cycle engine, it would be desirable that the bleed opening 53 and the compression release outlet conduit 49 be connected to a lower pressure area connected to the crankcase so as to minimize or eliminate oil loss to the atmosphere. The bleed opening connection might be by way of the cylinder, much as illustrated in the accompanying drawing or the outlet conduit 49 and bleed opening 53 might be connected to the crankcase by way of the valve chamber in such a four-stroke cycle engine.

From the foregoing it is now apparent that a novel automatic compression release mechanism has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. In an internal combustion engine having a cylinder and piston defining a variable volume combustion chamber, an automatic compression release mechanism comprising a passgeway communicating at one end thereof with the combustion chamber and at the other end thereof with a zone within the engine in which the pressure is lower than the pressure in the combustion chamber during the compression stroke of the piston, a valve chamber having an inlet port and an outlet port serially connecting the chamber in the passageway, a first one-way valve controlling the inlet port and closing the same when valve chamber pressure exceeds combustion chamber pressure, and a second one-way valve operable independently of the first valve controlling the outlet port and tending to close the same when the valve chamber pressure exceeds the pressure in the zone, the second valve being resiliently biased to an open position spaced from the outlet port and movable to a closed position in response to pressure generated in the passageway when a fuel-air mixture is ignited in the combustion chamber, the first and second valves comprising opposed cantilevered ends of a centrally supported flexible plate, both ends being urged to their respective closed positions in response to a pressure build-up in the chamber whereby both of the valves tend to be maintained in a closed position when the engine is running, the valve chamber comprising a pair of valve chamber portions joinable to simultaneously sealingly form the cavity and centrally support the flexible plate.

2. The compression release mechanism of claim 1 wherein the inlet and outlet ports are both formed in the same valve chamber portion, the other chamber portion including means near each plate end on sides thereof opposite the inlet and outlet ports for limiting movement of the plate ends away from the inlet and outlet ports respectively.

3. In an internal combustion engine having a cylinder and piston defining a variable volume combustion chamber, an automatic compression release mechanism comprising a passageway communicating at one end thereof with the combustion chamber and at the other end thereof with a zone in the engine in which the pressure is lower than the pressure in the combustion chamber during the compression stroke of the piston, a valve chamber having an inlet port and an outlet port serially connecting the chamber in the passageway, a first one-way valve controlling the inlet port and closing the same when valve chamber pressure exceeds combustion chamber pressure, a second one-way valve operable independently of the first valve controlling the outlet port and tending to close the same when the valve chamber pressure exceeds the pressure in the zone, the second valve being resiliently biased to an open position spaced from the outlet port and movable to a closed position in response to pressure generated in the passageway when a fuel-air mixture is ignited in the combustion chamber, the first and second valves being both urged to their respective closed positions in response to a pressure build-up in the chamber, means for slowly diminishing the chamber pressure to release each valve to return to its respective open position a predetermined time after the engine stops running including a restricted passageway from the chamber to the zone independent of the second valve, continued engine operation maintaining the pressure within the chamber whereby both of the valves tend to be maintained in a closed position when the engine is running.

4. The compression release mechanism of claim 3 wherein the zone comprises an engine exhaust conduit.

5. The compression release mechanism of claim 4 wherein the zone further includes a hollow interior portion of the engine piston pin.

6. In a two stroke cycle internal combustion engine having a cylinder and piston defining a variable volume combustion chamber with at least a cylinder side wall exhaust port opened and closed by piston movement, an automatic compression release mechanism comprising a passageway including the cylinder side wall exhaust port communicating at one end thereof with the combustion chamber and at the other end thereof with an engine exhaust conduit in which the pressure is lower than the pressure in the combustion chamber during the compression stroke of the piston, a valve chamber having an inlet port and an outlet port serially connecting the chamber in the passageway, a first one-way valve controlling the inlet port and closing the same when valve chamber pressure exceeds combustion chamber pressure, a second one-way valve operable independently of the first valve controlling the outlet port and tending to close the same when the valve chamber pressure exceeds the pressure in the exhaust conduit, the second valve being resiliently biased to an open position spaced from the outlet port and movable to a closed position in response to pressure generated in the passageway when a fuel-air mixture is ignited in the combustion chamber, the first and second valves being both urged to their respective closed positions in response to a pressure build-up in the chamber whereby both of the valves tend to be maintained in a closed position when the engine is running.

7. The compression release mechanism of claim 6 wherein the piston blocks the passageway during a portion of each engine cycle.

8. The compression release mechanism of claim 7 wherein the portion of the engine cycle during which the passageway is blocked is substantially that portion of the engine cycle during which the combustion chamber communicates with the side wall exhaust port.

9. The compression release mechanism of claim 6 wherein the first and second valves comprise opposed cantilevered ends of a centrally supported flexible plate.

10. The compression release mechanism of claim 6 further comprising means for slowly diminishing the chamber pressure to release each valve to return to its respective open position a predetermined time after the engine stops running.

11. The compression release mechanism of claim 10 wherein the means for diminishing chamber pressure includes a restricted passageway from the chamber independent of the second valve communicating with the exhaust port valve.

12. The compression release mechanism of claim 6 wherein the passageway communicates with the engine exhaust conduit by way of a piston duct movable with the piston and periodically opening and closing the passageway as the piston moves during engine operation.

13. The compression release mechanism of claim 12 wherein the piston includes a piston pin for coupling the piston to a connecting rod, the piston duct comprising a hollow channel extending through the piston pin.

14. The compression release mechanism of claim 12 further comprising means for slowly diminishing the chamber pressure to release each valve to return to its respective open position a predetermined time after the engine stops running including a restricted passageway from the chamber to the end of the piston duct diametrically opposite the side wall exhaust port and independent of the second valve.

15. The compression release mechanism of claim 6 wherein the first and second valves comprise opposed cantilevered ends of a centrally supported flexible plate.

16. The compression release mechanism of claim 15 further comprising means near each plate end on sides thereof opposite the inlet and outlet ports for limiting movement of the plate ends away from the inlet and outlet ports respectively.

* * * * *

UNITED STATES PATENT AND TRADEMARK OFFICE

CERTIFICATE OF CORRECTION

PATENT NO. : 4,252,092

DATED : February 24, 1981

INVENTOR(S) : Vernon R. Kaufman, Thomas G. Guntly & C. Kelly

It is certified that error appears in the above-identified patent and that said Letters Patent are hereby corrected as shown below:

IN THE CLAIMS

Claim 11, Col. 7, Line 21, Delete "valve" after port

Signed and Sealed this

*Twenty-sixth* Day of *May 1981*

[SEAL]

*Attest:*

RENE D. TEGTMEYER

*Attesting Officer*

*Acting Commissioner of Patents and Trademarks*